US007735829B2

(12) United States Patent
Butterfaβ et al.

(10) Patent No.: US 7,735,829 B2
(45) Date of Patent: Jun. 15, 2010

(54) METHOD AND APPARATUS FOR TURNING A SHEET DURING ITS TRANSPORT THROUGH A PRINTING PRESS

(75) Inventors: Hans Butterfaβ, Heidelberg (DE); Daniel Conzelmann, Dielheim (DE); Peter Hachmann, Dossenheim (DE); Arno Jünger, Nuβloch (DE); Markus Kramer, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 17 days.

(21) Appl. No.: 11/935,636

(22) Filed: Nov. 6, 2007

(65) Prior Publication Data

US 2008/0105143 A1 May 8, 2008

(51) Int. Cl.
*B65H 5/02* (2006.01)
*B65H 29/68* (2006.01)

(52) U.S. Cl. ..... 271/277; 271/276; 271/183; 101/246; 101/232

(58) Field of Classification Search ..... 271/276, 271/277, 69, 183; 101/230, 232, 246
See application file for complete search history.

(56) References Cited

U.S. PATENT DOCUMENTS

| | | | | |
|---|---|---|---|---|
| 3,986,455 | A * | 10/1976 | Jeschke et al. | 101/409 |
| 4,026,209 | A * | 5/1977 | Wirz et al. | 101/231 |
| 4,241,659 | A | 12/1980 | Fischer | |
| 4,723,489 | A * | 2/1988 | Emrich et al. | 101/230 |
| 5,134,938 | A | 8/1992 | Büsse et al. | |
| 5,439,029 | A | 8/1995 | Becker | |
| 6,098,543 | A | 8/2000 | Becker et al. | |
| 6,722,276 | B1 * | 4/2004 | Helmstadter | 101/230 |
| 6,896,258 | B2 * | 5/2005 | Kobayashi et al. | 271/276 |
| 7,150,456 | B2 | 12/2006 | Gerstenberger et al. | |
| 2007/0006754 | A1 * | 1/2007 | Eckart et al. | 101/232 |

FOREIGN PATENT DOCUMENTS

| | | | |
|---|---|---|---|
| DE | 2449122 | B1 | 10/1975 |
| DE | 2724621 | A1 | 12/1978 |
| DE | 4030070 | A1 | 3/1992 |
| DE | 4210009 | A1 | 9/1993 |
| DE | 9411462.5 | U1 | 9/1994 |
| DE | 4424970 | A1 | 1/1996 |
| DE | 19822306 | A1 | 11/1999 |
| DE | 19920371 | A1 | 12/1999 |
| DE | 19949412 | A1 | 4/2001 |
| DE | 10346782 | A1 | 5/2004 |

* cited by examiner

*Primary Examiner*—Patrick Mackey
*Assistant Examiner*—Ernesto Suarez
(74) *Attorney, Agent, or Firm*—Laurence A. Greenberg; Werner H. Stemer; Ralph E. Locher

(57) ABSTRACT

A method and an apparatus for turning a sheet during its transport through a printing press permit improved printing results as a result of improved sheet guidance. A sheet is tautened following a transfer from a first transport device to a second transport device.

2 Claims, 5 Drawing Sheets

METHOD AND APPARATUS FOR TURNING A SHEET DURING ITS TRANSPORT THROUGH A PRINTING PRESS

CROSS-REFERENCE TO RELATED APPLICATION

This application claims the priority, under 35 U.S.C. §119, of German Patent Application DE 10 2006 052 126.9, filed Nov. 6, 2006; the prior application is herewith incorporated by reference in its entirety.

BACKGROUND OF THE INVENTION

Field of the Invention

The invention relates to a method for turning a sheet during its transport through a printing press, in which a leading edge of the sheet is moved on a first transport device along a desired path and a trailing edge of the sheet is transferred to a second transport device. The invention also relates to an apparatus for turning a sheet during its transport through a printing press, including a first transfer drum having gripper systems for holding the sheet at the leading and trailing edges, each gripper system at the trailing sheet edge including a row of suction grippers placed at intervals and connected to a controllable vacuum source, a second transfer drum having a gripper system for accepting the sheet from the first transfer drum at the trailing sheet edge, and at least one drive for the synchronous revolution of the transfer drums.

In order to keep production costs of a multicolor sheet-fed printing press low, printing units thereof are constructed to print on only one side of a sheet and the printing units are fabricated with a high level of repetition. If, in a sheet-fed printing press having an inline configuration of the printing units, printing is to be carried out on both sides of the sheets, a turning apparatus for the sheets is provided between the last printing unit for printing on the front side and a following printing unit for printing on the rear side. Conventional turning apparatuses include a transfer drum, a storage drum and a turning drum between impression cylinders of the printing units. The transfer drum has a gripper system for holding a sheet at the front edge. The storage drum is implemented with a diameter twice as large as the impression cylinders and has two gripper systems for holding the sheet at the front edge and two suction gripper systems for holding the sheet at the rear edge. The turning drum has a tongs-type gripper system for holding the sheet edge trailing on the storage drum. All of the sheet-carrying cylinders are driven so as to revolve synchronously, for example by a gear wheel mechanism.

The gripper systems of the storage drum and of the turning drum each include individual grippers disposed along a straight gripper closing line. The gripper closing lines in each case lie parallel to the axis of rotation of the storage drum or turning drum. As is seen in the axial direction of the storage drum and of the turning drum, the gripper closing lines of the turning drum and of the storage drum during a sheet transfer form a common tangent line, through which there runs a center line which goes through the axes of rotation.

In order to turn a sheet, it is transferred from the gripper system of the transfer drum to a gripper system for the front sheet edge of the storage drum. During the rotation on the storage drum, the rear sheet edge is held by an associated suction gripper system of the storage drum. The sheet is led past the tangent line by the leading edge gripper system of the storage drum. Once the rear edge of the sheet reaches the tangent line, a transfer to the tongs-type grippers of the turning drum is carried out. During the further revolution of the drums, the sheet is peeled off the circumferential surface of the storage drum, with the suction action of the suction grippers being stopped. The vacuum of the suction grippers is led to the storage drum through a rotary leadthrough, as is described in German Published, Non-Prosecuted Patent Application DE 42 10 009 A1, corresponding to U.S. Pat. No. 5,439,029, for example. The vacuum is maintained only in a rotational angle range of the storage drum between the transfer of the rear edge from the transfer drum to the turning drum. If the leading edge gripper system of the storage drum opens at a predefined rotational angle, a free flight phase of the sheet begins. The sheet is held only at one sheet edge by the tongs-type grippers of the turning drum until it is transferred to the gripper system of the impression cylinder disposed downstream.

Since it is separated from the storage drum, at the edge at which the tongs-type grippers act, the sheet has a different speed than that of the free-flying new rear edge. Before leaving the storage drum, the future rear edge of the sheet is moved at the path speed of the storage drum. The speed of the future rear edge subsequently decreases to zero. The direction of movement of the rear edge then changes from zero to a path speed which results from the rotation of the tongs-type grippers of the turning drum.

Due to the speed changes, the sheet is moved out of its ideal path as a result of dynamic forces and other external interfering forces. The sheet guided freely at the rear edge tends to form waves and, as a result of whipping effects, to collide with components of the storage drum and guide elements, which leads to undesired printing results.

In order to improve separation of a sheet from the circumferential surface of a storage drum, in the case of a turning apparatus according to German Published, Non-Prosecuted Patent Application DE 199 49 412 A1, corresponding to U.S. Pat. No. 6,722,276, the storage drum is constructed with a recess that is open at one edge. Air is introduced through the recess in a vacuum region which, during the separation, forms in a space between the storage drum, the turning drum and the sheet. The control of the vacuum on the rear edge of the sheet is not affected.

BRIEF SUMMARY OF THE INVENTION

It is accordingly an object of the invention to provide a method and an apparatus for turning a sheet during its transport through a printing press, which overcome the hereinafore-mentioned disadvantages of the heretofore-known methods and apparatuses of this general type and which permit improved printing results as a result of improved sheet guidance.

With the foregoing and other objects in view there is provided, in accordance with the invention, a method for turning a sheet during its transport through a printing press. The method comprises moving a leading edge of the sheet on a first transport device along a desired path, transferring a trailing edge of the sheet to a second transport device, and tautening the sheet in a predefined rotational angle range following the transfer.

With the objects of the invention in view, there is concomitantly provided an apparatus for turning a sheet during its transport through a printing press. The apparatus comprises a first transfer drum having gripper systems for holding the sheet at a leading and a trailing edge. Each of the gripper systems at the trailing edge includes a row of suction grippers placed at intervals and connected to a controllable vacuum source. A second transfer drum has a gripper system for accepting the sheet at the trailing edge from the first transfer drum. At least one drive is provided for synchronous revolution of the transfer drums. A braking configuration is provided for the sheet running off the first transfer drum.

Other features which are considered as characteristic for the invention are set forth in the appended claims.

Although the invention is illustrated and described herein as embodied in a method and an apparatus for turning a sheet during its transport through a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
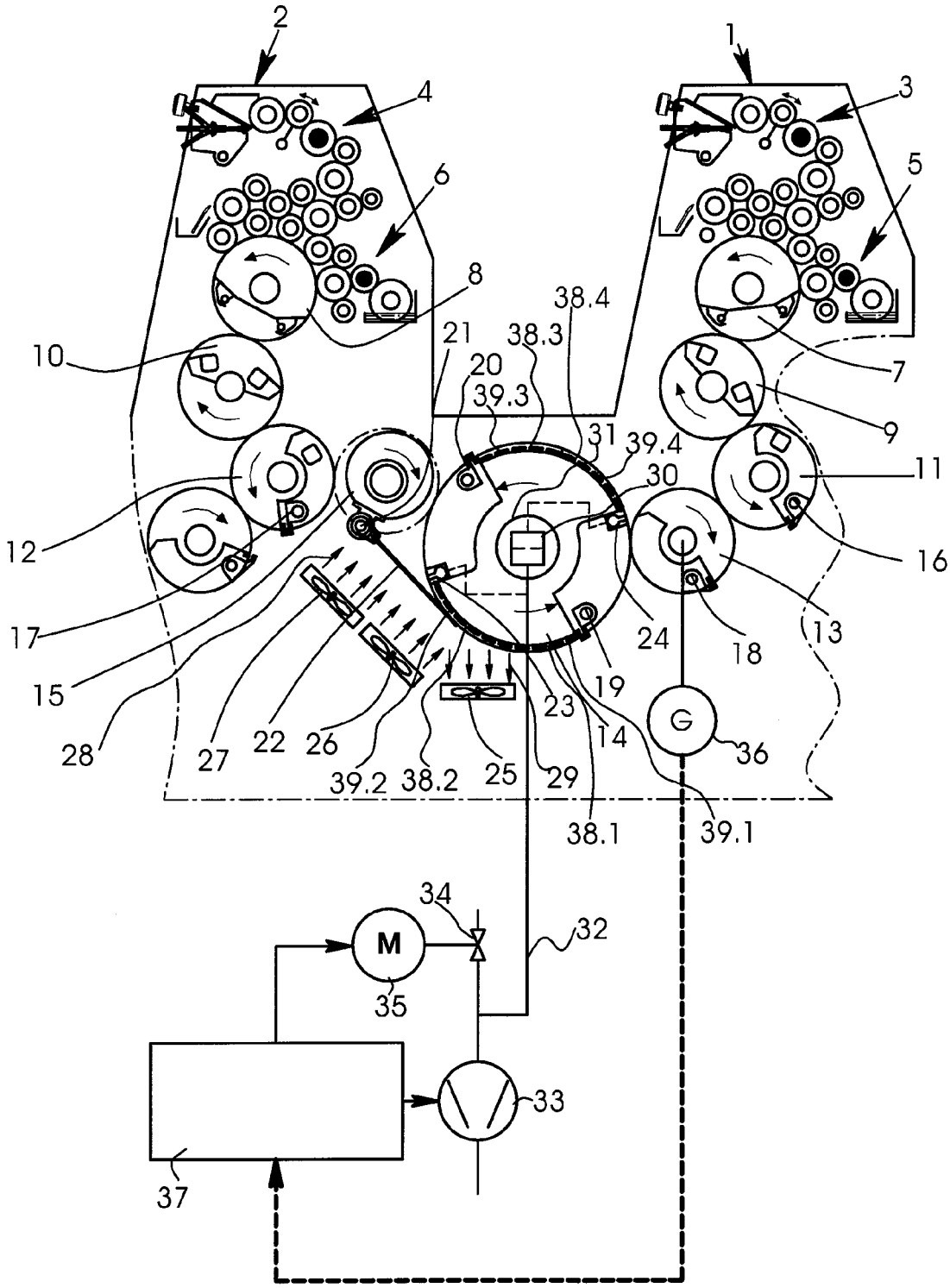
FIG. 1 is a diagrammatic, sectional view of two printing units and a turning apparatus of a sheet-fed printing press.

Referring now to the figures of the drawings in detail and first, particularly, to FIG. 1 thereof, there are seen two printing units 1, 2 of a sheet-fed printing press, each having an inking unit 3, 4, a dampening unit 5, 6, a plate cylinder 7, 8, a transfer cylinder 9, 10 and an impression cylinder 11, 12. A turning apparatus disposed between the printing units 1, 2 has a transfer drum 13, a storage drum 14 and a turning drum 15. All of the cylinders and drums are coupled to a gear train and revolve in directions indicated by arrows. The impression cylinders 11, 12, the transfer drum 13, the storage drum 14 and the turning drum 15 have gripper systems 16-21 for holding a sheet 22 at the leading sheet edge. The storage drum 14 additionally has a first transport device in the from of suction gripper systems 23, 24 for holding a sheet 22 at the trailing sheet edge. Pneumatic sheet guides 25-27, from which blown air 28 exits and vacuum 29 enters, are disposed along a transport path of the sheet 22 between the storage drum 14 and the turning drum 15. The suction gripper systems 23, 24 are fed through a pneumatic rotary leadthrough 30 on a journal 31 of the storage drum 14. A suction line 32 leads from the rotary leadthrough 30 to a suction connection of a suction blower 33. The suction connection is also connected to a secondary air valve 34, which can be controlled by a motor 35. The rotational position of the storage drum 14 is registered through a rotary encoder 36 on the transfer drum 13. The rotary encoder 36, the motor 35 and the blower 33 are connected to a control device 37.

Figure 2:
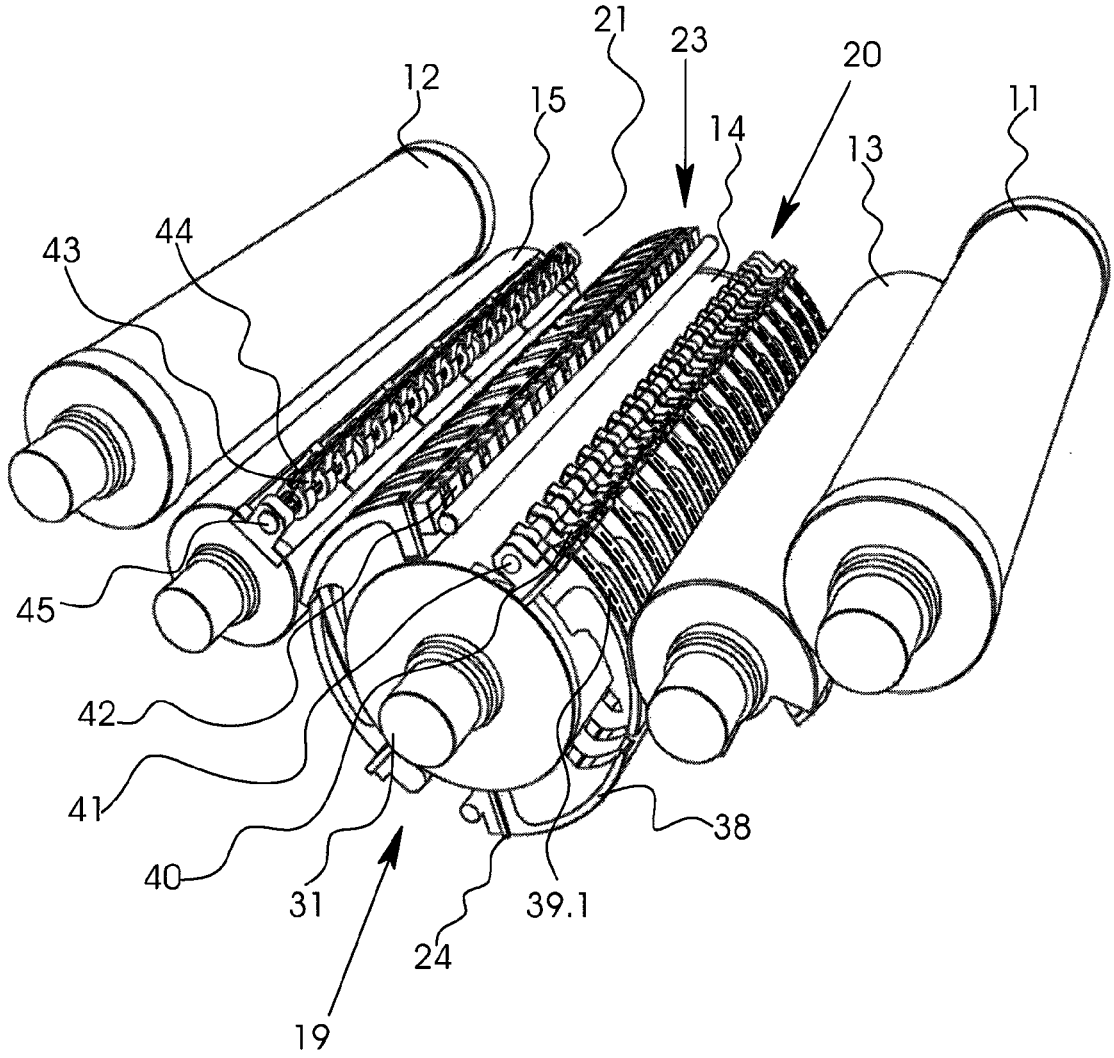
FIG. 2 is a perspective view of drums of a turning apparatus.

A perspective illustration according to FIG. 2 shows the impression cylinders 11, 12, the transfer drum 13, the storage drum 14 and the turning drum 15 in more detail. The effective diameter of the storage drum 14 is twice as large as that of the impression cylinders 11, 12. The storage drum 14 contains concentrically disposed hoop-like holders 38.1-38.4 having sheet support surfaces located on the outside. In each case two groups of holders 38.1, 38.2; 38.3, 38.4 are used to support a sheet 22 and interengage in the manner of a comb. Suction grooves 39.1-39.4 in the sheet support surfaces are connected to the blower 33 through the rotary leadthrough 30 and run in the circumferential direction of the storage drum 14. The gripper systems 19, 20 each include a large number of individual grippers 40 on a gripper shaft 41. The individual grippers 40 are opened and closed through the use of a cam mechanism and a gear wheel mechanism. The suction gripper systems 23, 24 each contain a large number of suckers 42, which act on the rear edge of a sheet 22. The grippers of the second transport device or gripper system 21 are constructed as tongs-type grippers each having two interacting gripper fingers 43, 44. During a rotation of the turning drum 15, the gripper fingers 43, 44 complete a pivoting movement about a gripper shaft 45 under cam control.

Figure 3:
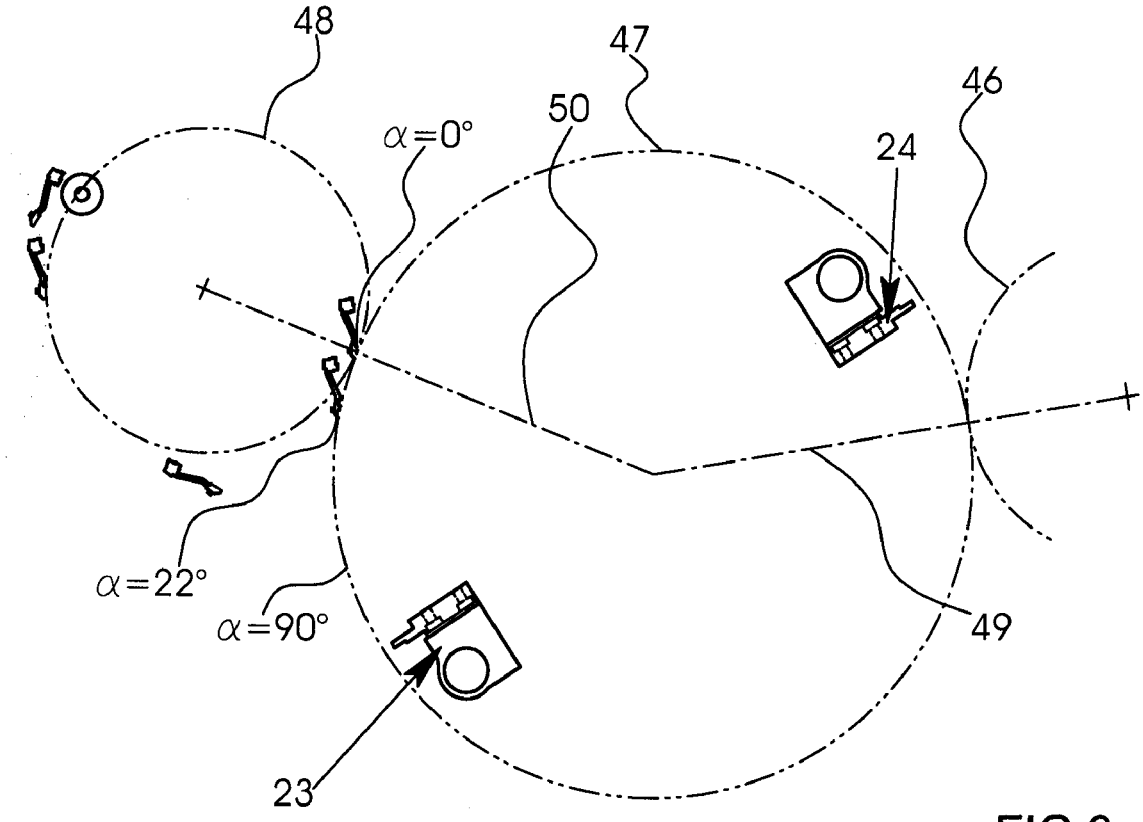
FIG. 3 is a diagrammatic view illustrating vacuum control on suction grippers.
Figure 4:
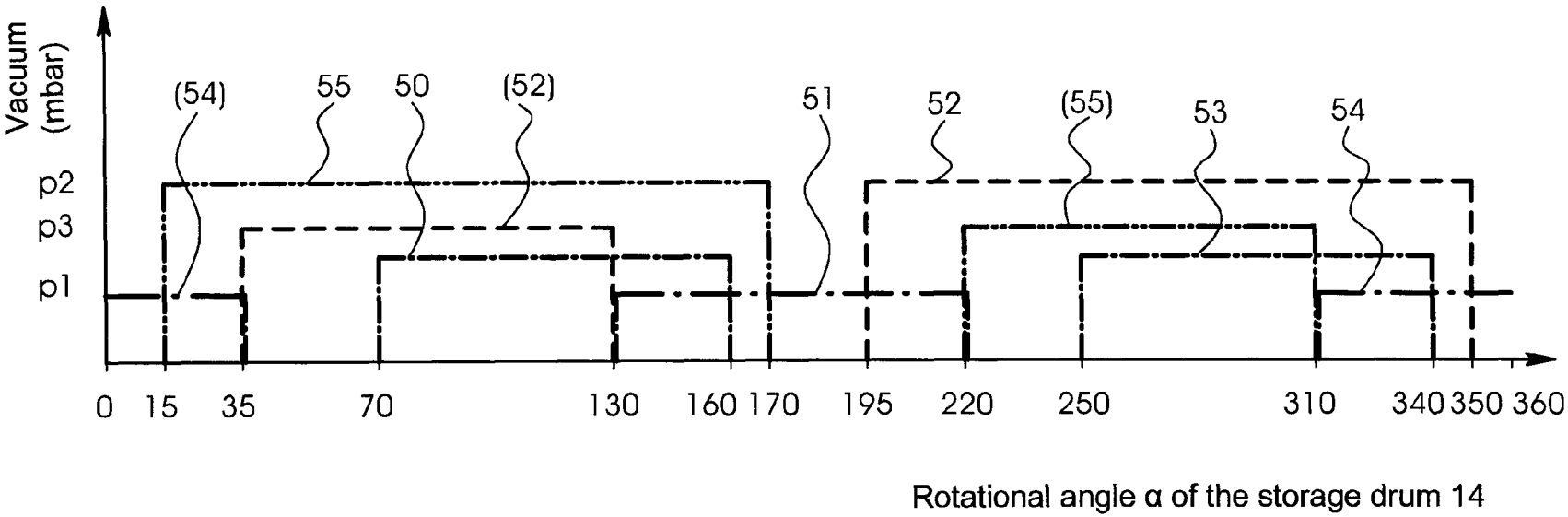
FIG. 4 is a diagram illustrating vacuum control on a storage drum.

The transfer of a sheet 22 from the storage drum 14 to the turning drum 15 will be described by using a diagrammatic illustration in FIG. 3 and a diagram in FIG. 4. FIG. 3 shows, in profile, circles of rotation 46-48 of the gripper system 18 of the transfer drum 13, of the gripper systems 19, 20, 23, 24 of the storage drum 14, and of the gripper system 21 of the turning drum 15. Straight lines joining the center of the circles 46, 47 and 48 are transfer center lines 49, 50.

At a rotational angle of $\alpha=70°$, the suction grooves 39.1 of the holders 38.1 have a vacuum p1 applied to them. The pressure variation in the suction grooves 39.1 is indicated by a curve 50. At a rotational angle of $\alpha=75°$, the leading sheet edge reaches the transfer center line 49, on which the sheet 22 is transferred from the gripper system 18 of the transfer drum 13 to the gripper system 19 of the storage drum 14. At a rotational angle of $\alpha=130°$, the trailing suction grooves 39.2 of the holders 38.2 have the vacuum p1 applied to them. The pressure variation in the suction grooves 39.2 is illustrated as a curve 51. At a rotational angle of $\alpha=160°$, the connection of the suction grooves 39.1 to the suction blower 33 is interrupted. At a rotational angle of $\alpha=195°$, the trailing sheet edge of the sheet 22 reaches the transfer center line 49, and the suckers 42 of the suction gripper system 23 have a vacuum p2 applied to them. The pressure variation on the suckers 42 of the suction gripper system 23 is seen from a curve 52. In the further course, the front sheet edge of the first sheet 22 is guided past the transfer center line 50. At a rotational angle of $\alpha=350°$, a vacuum p2 on the suckers 42 of the suction gripper 23 is shut off and the suckers 42 are ventilated. At a rotational angle of $\alpha=360°$, the rear edge of the first sheet 22 reaches the transfer center line 50 and is accepted by the gripper fingers 43, 44 of the tongs-type gripper system 21, with the leading sheet edge being released from the gripper system 19. Starting at a rotational angle of $\alpha=22°$, the first sheet 22 begins to be peeled off by the holders 38.2 and 38.1. Up to a rotational angle of $\alpha=35°$, the first sheet 22 is guided only by the gripper system 21 of the turning drum 15. Starting from a rotational angle of $\alpha=35°$, the suckers 42 of the suction gripper system 23 again have a vacuum p3 applied to them. As a result of the renewed application of the vacuum, the first sheet 22 is held by the suckers 42 of the suction gripper system 23 again, starting from a rotational angle of $\alpha=90°$. The free trailing end of the first sheet 22 is tautened. The suckers 42 of the suction gripper system 23 carry out a relative movement in relation to the sheet 22 during this process. This braking phase for the trailing end runs as far as a rotational angle of $\alpha=130°$ following the transfer of the trailing sheet edge to the gripper system 21. Depending on the sheet length, the suckers 42 of the suction gripper system 23 leave the rear sheet edge in a rotational angle range between $\alpha$=190° and $\alpha$=130°.

The sheet transport described above is repeated periodically. While one sheet 22 is being accepted by the gripper system 19 at the rotational angle of $\alpha$=75°, a preceding sheet 22 is being transported in the same way on the opposite holders 38.3, 38.4 with the gripper system 20 and the suction gripper system 24. Curves 53, 54 reproduce the variation of the vacuum p1 in the suction grooves 39.3, 39.4 of the holders 38.3, 38.4. A curve 55 illustrates the variation of the vacuum on the suckers 42 of the suction gripper system 24. The braking phase of the sheet 22 preceding the first sheet 22 runs in a rotational angle range between $\alpha$=215° and $\alpha$=310°.

Figure 5:
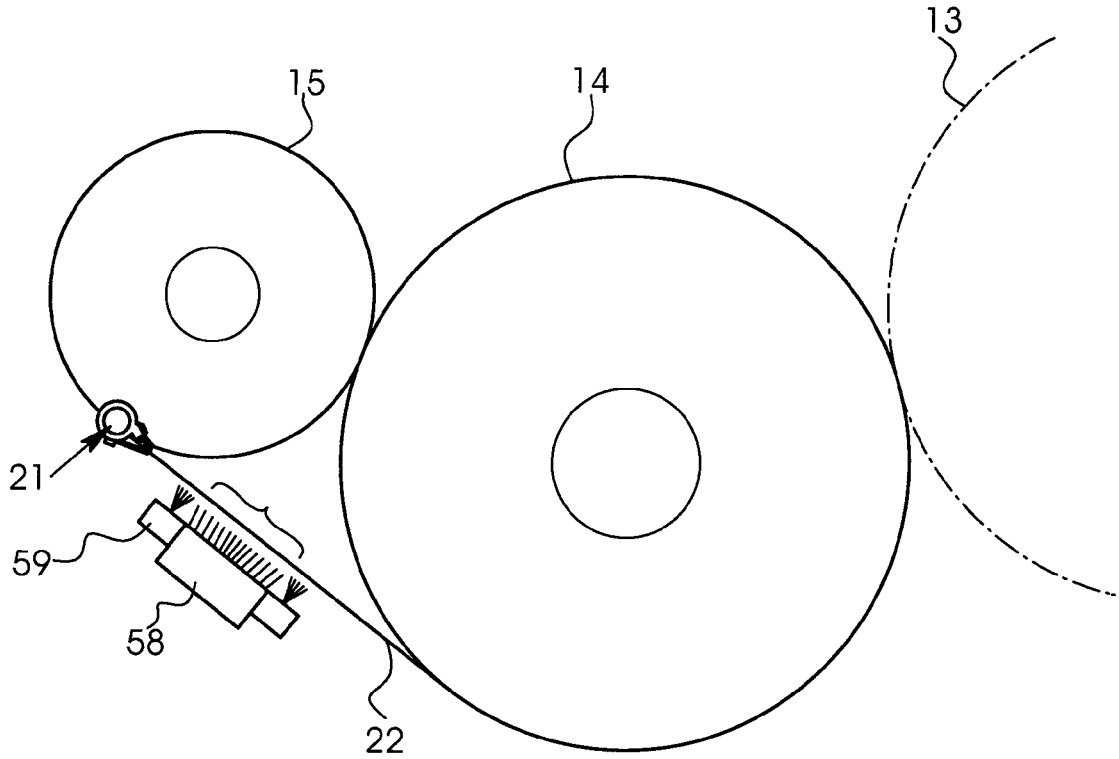
FIG. 5 is an elevational view illustrating tautening of a sheet with a magnetic field.

FIG. 5 shows an apparatus in which a braking configuration for a sheet 22 is fixed to a frame. The braking configuration includes a generator 58 for an alternating magnetic field and a pneumatic guide device 59 for the sheet 22. As the sheet 22 runs past the generator 58, a current is induced in the ferromagnetic material of the sheet 22 or the printing ink on the sheet 22. A magnetic field originating from an eddy current counteracts the field from the generator 58, so that the sheet 22 is braked. The braking effect can be adjusted to the sheet thickness and/or locally to the sheet 22 by changing the field strength of the field of the generator 58. Therefore, a formation of waves in the sheet 22 and whipping effects at the trailing sheet edge can be avoided or reduced. The guide device 59 prevents the sheet 22 from touching the generator 58.

The invention claimed is:

1. A method for turning a sheet during its transport through a printing press, the method comprising the following steps:

moving the sheet on a circular path on a first transfer drum while being held in a first transport device in the form of mechanical grippers at a leading sheet edge and being held in suction grippers at a trailing sheet edge;

transferring the trailing edge of the sheet to a second transport device in the form of a gripper system of an adjacent second transfer drum revolving synchronously;

during the transfer, shutting off vacuum on the suction grippers, holding the sheet by the mechanical grippers in a predefined first rotational angle range after the transfer, and releasing the sheet from the mechanical grippers after leaving the rotational angle range; and tautening and braking the sheet in a predefined second rotational angle range, after being released from the mechanical grippers, by setting the vacuum of the suction grippers to attract the sheet by suction.

2. The method according to claim 1, which further comprises adjusting a braking force as a function of sheet thickness.

* * * * *